US011033790B2

(12) United States Patent
Manou

(10) Patent No.: US 11,033,790 B2
(45) Date of Patent: Jun. 15, 2021

(54) MULTIPLE SPORTS GAMES TOSS SYSTEM AND METHOD THEREFOR

(71) Applicant: Nicholas Manou, North Myrtle Beach, SC (US)

(72) Inventor: Nicholas Manou, North Myrtle Beach, SC (US)

( * ) Notice: Subject to any disclaimer, the term of this patent is extended or adjusted under 35 U.S.C. 154(b) by 0 days.

(21) Appl. No.: 16/580,370

(22) Filed: Sep. 24, 2019

(65) Prior Publication Data

US 2021/0086049 A1 Mar. 25, 2021

(51) Int. Cl.
*A63B 63/08* (2006.01)
*A63B 67/06* (2006.01)

(52) U.S. Cl.
CPC ..... *A63B 67/06* (2013.01); *A63B 63/08* (2013.01); *A63B 2067/061* (2013.01)

(58) Field of Classification Search
CPC ... A63B 67/06; A63B 67/08; A63B 2067/061; A63B 63/08
See application file for complete search history.

(56) References Cited

U.S. PATENT DOCUMENTS 4,186,925 A * 2/1980 Goldfarb ..... A63B 67/06 273/127 D
4,460,177 A * 7/1984 Slayton ..... A63B 63/08 273/126 A
4,691,923 A * 9/1987 Schwartz ..... A63B 63/08 273/127 B
4,726,591 A * 2/1988 Johnson ..... A63B 67/06 273/338
5,056,796 A * 10/1991 Conville ..... A63B 67/06 273/402
10,835,794 B1 * 11/2020 McMahon ..... A63B 67/06
2007/0001399 A1 * 1/2007 Staver ..... A63B 67/06 273/317.3
2015/0115531 A1 * 4/2015 Ali ..... A63B 63/00 273/398
2016/0144256 A1 * 5/2016 Lee ..... A63B 69/002 473/416
2017/0173428 A1 * 6/2017 Wolters ..... A63B 67/06
2017/0209784 A1 * 7/2017 Pavey ..... A63F 9/02
2018/0056155 A1 * 3/2018 McAuley ..... A63B 69/3623
2018/0256954 A1 * 9/2018 Schmidt ..... A63B 63/08
2019/0381379 A1 * 12/2019 Angel ..... A63B 63/08
2019/0388752 A1 * 12/2019 Crews ..... A63B 67/06
2020/0147465 A1 * 5/2020 Chille ..... A63B 63/08
2020/0360783 A1 * 11/2020 Rause ..... A63B 67/06

* cited by examiner

*Primary Examiner* — Raleigh W Chiu
(74) *Attorney, Agent, or Firm* — Patrick Stanzione; Stanzione & Associates, PLLC

(57) ABSTRACT

A multiple sports game board system having a display surface that is reconfigurable to simulate multiple sports games playable by tossing bean bags thereat. The display surface including a large diamond extending from side to side and top to bottom of the display area, and having a plurality of equal size small diamonds formed in the large diamond. Each of the small diamonds having a doorway extending therethrough configurable to close and opening an opening extending through the display surface within the respective small diamond to receive bean bags through the doorways that are disposed in the open position to obtain points for a plurality of different sports games.

11 Claims, 11 Drawing Sheets

CORN HOLE

CLOSE FOUR CORNERS

BASEBALL

HOLE IN ONE

9 HOLE GOLF/POINT SCALE

TIC-TAC-TOE

MULTIPLE SPORTS GAMES TOSS SYSTEM AND METHOD THEREFOR

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to a recreational sports game board system having a display surface configured to convert into multiple different games resembling sports. More particularly, the present inventive concept relates to a recreational game board system having a display surface configured to have a shape and multiple doors to simulate multiple sports games.

Description of the Related Art

U.S. Pat. No. 4,726,591 is directed to a target game device 10 having a single target opening 12 for tossing a bean bag thereat. The device 10 also includes arch-shaped targets 14 and 18 to receive a golf ball therein, as well as a removable peg target 20 for tossing rings thereat.

U.S. Pat. No. 5,332,230 is directed to a bag toss game device that is foldable and includes a plurality of square holes as well as hook and loop fastener peripheries and patches for tossing a bean bag thereat.

U.S. Pat. No. 8,657,293 is directed to a tossing projectile game that has the shape of a baseball field, including an infield and an outfield. Projectiles such as a bean bag and a traditional washer can be tossed toward the game.

U.S. Pat. No. 8,915,498 is directed to a disk 1 including a trapdoor 3 that modifies an otherwise regular cornhole board with a single target hole into a closed space. The disk 1 is connected to the trapdoor 3 by a spring hinge 4.

U.S. Pat. No. 7,887,059 is directed to a bag toss game with a landing surface that changes direction to simulate different golf greens along a golf course.

US Patent Publication No. 2009/0174145 is directed to device 10 with a plurality of openings and a goal 18. The device includes a plurality of templates which can be placed thereon to provide the effect of different games.

US Patent Publication No. 2008/0042360 is directed to a bag toss game that simulates a card game.

US Patent Publication No. 2010/0320692 is directed to a bag toss game the simulates a dart board.

US Patent Publication No. 2017/0173428 is directed to baseball-based bean bag tossing game, where holes are specifically positioned to simulate hits and outs.

These conventional game boards are limited to simulating one or two games, or require a replacement template to simulate more than two games. As a result, users are limited to playing only one or two games, or must carry multiple different templates along with the game board in order to have the option of playing more than one or two games with the game board.

Accordingly, what is needed is a single game board system that is configured to adapt to simulating multiple different games without requiring changing the surface of the board in order to adapt to the multiple different games.

SUMMARY OF THE INVENTIVE CONCEPT

The present general inventive concept provides a recreational sports game board system configured to convert into multiple different games simulating sports. More particularly, the present inventive concept relates to a recreational game board system configured to have a shape and multiple doors to simulate multiple sports games.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a multi-configurable sports game system, comprising: a three dimensional game board including: a display surface, the display surface including: a large diamond shape disposed thereon and having a top most corner contacting a top portion T of the display surface, a bottom most corner contacting a bottom portion B of the display surface, a left most corner contacting a first side and a right most corner contacting a second side opposite the first side, nine small diamond shapes disposed within the large diamond shape that fill in the entire large diamond shape, and nine holes extending through the display surface, each hole being disposed within a respective small diamond shape, a rotating door connected adjacent to a periphery of each hole via a hinge such that each rotating door can rotate between an open position below the display surface where the respective hole is completely exposed and a closed position where the respective hole is completely filled in by the door, a latch disposed at a back side of the display surface adjacent to every hole to lock and unlock a respective door within the respective hole, each latch being positioned at an angle of approximately 180 degrees from the respective hinge, and a first pair of legs, each first leg extending from a bottom of the display surface at each of opposite sides of a top end of the game board.

In an exemplary embodiment, the multi-configurable sports game system may further comprise: at least two sets of numbers disposed in each of the small diamond shapes representing scores to be obtained from at least four separate sports games; and four circles formed on the display surface outside the large diamond shape, one circle being formed between each of a top side of the large diamond shape and an edge of the game board, another top side of the large diamond shape and another edge of the game board, a bottom side of the large diamond shape and an edge of the game board, and another bottom side of the large diamond shape and another edge of the game board, the four circles representing scores to be obtained in at least one other sports game separate from the scores disposed within the small diamond shapes.

In another exemplary embodiment, the multi-configurable sports game system may further comprise: words provided in each of a lower most small diamond which represents home base, a right most small diamond which represents first base, a top most small diamond which represents second base, and a left most small diamond which represents third base of baseball.

In another exemplary embodiment, the multi-configurable sports game board system may further comprise: a second pair of legs, each second leg extending from a bottom of the display surface at each of opposite sides of a middle portion of the game board and contacting a surface on which the first pair of legs rest and the bottom of the game board rests.

In still another exemplary embodiment, the multi-configurable sports game system may further comprise: a bracket disposed on a top side thereof to receive a post for a basketball hoop and a game of ring toss.

The foregoing and/or other features and utilities of the present general inventive concept may also be achieved by providing a multi-configurable sports game board system, comprising: a display surface including: a large diamond disposed thereon having four points, each point extending to a top of the display surface, a bottom of the display surface, and two opposite sides of the display surface, nine equal sized small diamonds disposed within the large diamond and all being in contact with adjacent ones thereof to fill the entire area of the large diamond, each small diamond having at least two sets of numbers disposed therein representing scores to be obtained in at least two separate sports games and one set of words disposed in at least four of the nine small diamonds, the words representing bases in the game of baseball, a rotatable door formed in each of the nine small diamonds, each door being configured to rotate to expose a corresponding hole extending through the display surface and to close the corresponding hole to form a continuous surface with the display surface, and a latch formed at a rear side of the display surface adjacent to each hole, each latch being movable to lock a respective door in a closed position within the corresponding hole and to unlock the door to rotate the door outside of the corresponding hole and below the display surface.

In an exemplary embodiment, the multi-configurable sports game board system may further comprise: at least two legs extending from a bottom thereof configured to prop up a top end thereof.

In another exemplary embodiment, the multi-configurable sports board game system may further comprise: a bracket disposed on the top end thereof to receive a post connected to at least a basketball hoop and to a set of poles connected together and configured to receive a ring tossed thereover.

In another exemplary embodiment, the game board and display surface comprises eight sides.

In still another exemplary embodiment, the multi-configurable sports game board system may further comprise: a circle disposed at a top portion of the display surface at each of opposite sides thereof and outside the large diamond and at a bottom portion of the display surface at each of opposite sides thereof and outside the large diamond, each of the circles configured to receive a tossed bean bag thereon to gain a point.

In still another exemplary embodiment, the multi-configurable sports game board system may further comprise: a hinge attached at one side to each door and attached at a opposite side to the rear side of the display surface adjacent to a corresponding hole, the hinges being configured to rotate the corresponding doors between a position within a corresponding hole and a position to expose the corresponding hole.

The foregoing and/or other features and utilities of the present general inventive concept may also be achieved by providing a method of reconfiguring a single sports game board surface as desired to simulate at least eight different sports games played with bean bags, the method comprising: providing a display surface having eight sides; forming a large diamond shape within the display surface such that one corner of the diamond extends to an upper most side of the display surface, one corner of the diamond extends to a lower most side of the display surface, one corner of the diamond extends to a right most side of the display surface and one corner of the diamond extends to a left most side of the display surface, forming nine equal sized small diamonds within the large diamond such that the small diamonds fill the entire space of the large diamond; forming an opening through a center portion of each of the small diamonds that can be closed and opened as desired by rotating a corresponding attached door into and out of the opening, the doors being configured to be opened and closed in different sequences to simulate a plurality of different sports games.

In an exemplary embodiment, the method may further comprise: forming at least two separate sets of numbers in each of the small diamonds to represent scores to be obtained for at least two separate sports games; and forming a set of words in four of the small diamonds to represent bases to be obtained in the game of baseball.

In another exemplary embodiment, the method may further comprise: forming four circles on the display surface outside the area of the large diamond, one circle being disposed at each of top opposite sides of the display surface and one circle being disposed at each of bottom opposite sides of the display surface In still another exemplary embodiment, the method may further comprise: removably attaching a basketball hoop to hover over a top most small diamond to receive a bean bag tossed therethrough.

In still another exemplary embodiment, the method may further comprise: removably attaching a ring toss multiple pole device to hover over a top portion of the display surface to receive rings tossed over the multiple poles to obtain points.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1A:
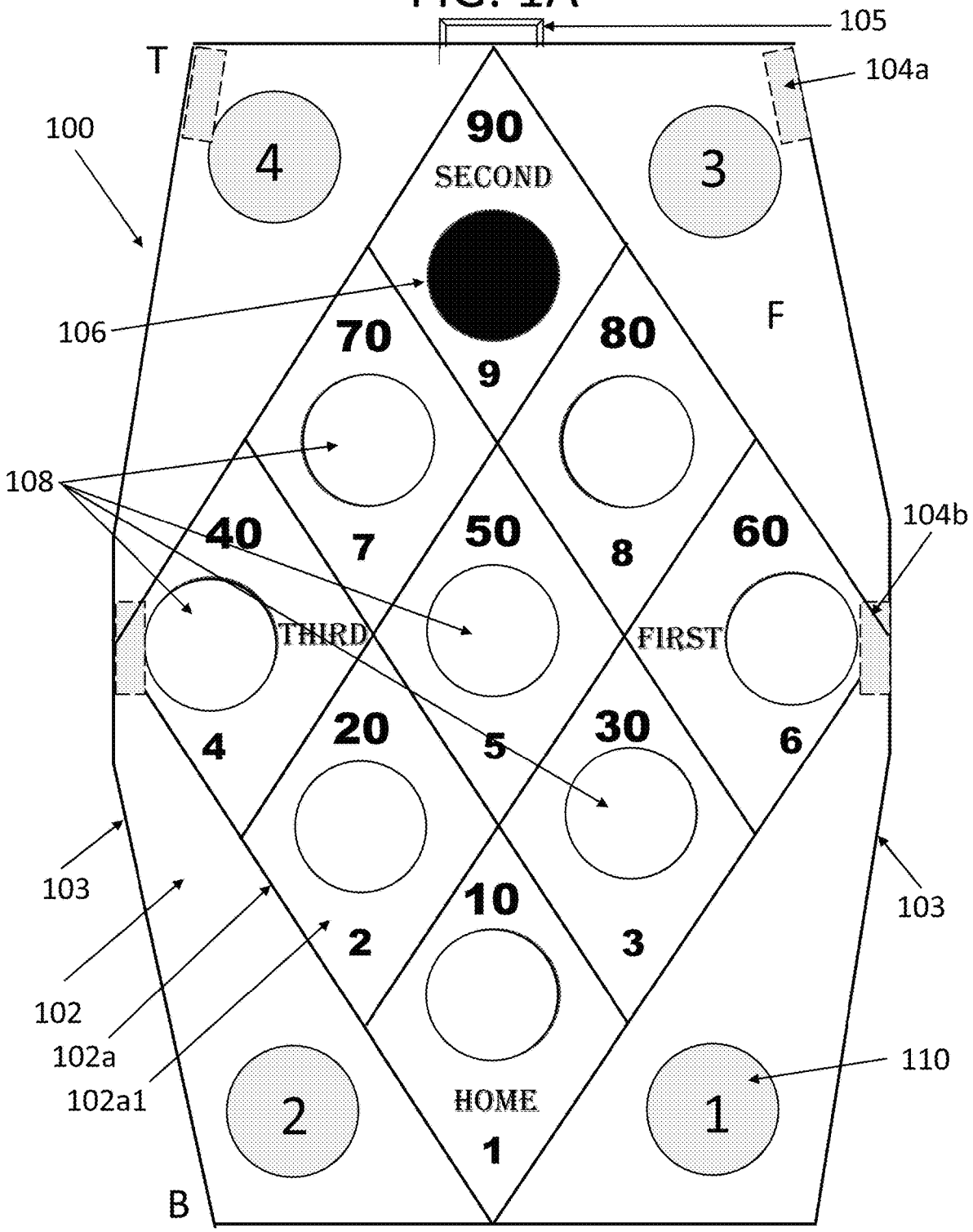
FIG. 1A illustrates a top view of a game board system according to an exemplary embodiment of the present inventive concept, simulating a game called "corn hole" bean bag toss.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein have to be defined based on the meaning of the terms together with the description throughout the specification.

Also, when a part "includes" or "comprises" an element, unless there is a particular description contrary thereto, the part can further include other elements, not excluding the other elements. In the following description, terms such as "unit" indicate a unit to process at least one function or operation, wherein the unit may be embodied as hardware or software or embodied by combining hardware and software.

Hereinafter, various exemplary embodiments of the present general inventive concept will be described in detail with reference to accompanying drawings.

Exemplary embodiments of the present general inventive concept are directed to a recreational sports game board system having a display surface configured to convert into multiple different games resembling sports, and a method therefor. More particularly, the present inventive concept relates to a recreational game board system having a display surface configured to have a shape and multiple doors to simulate multiple sports games, and a method therefor.

Figure 1B:
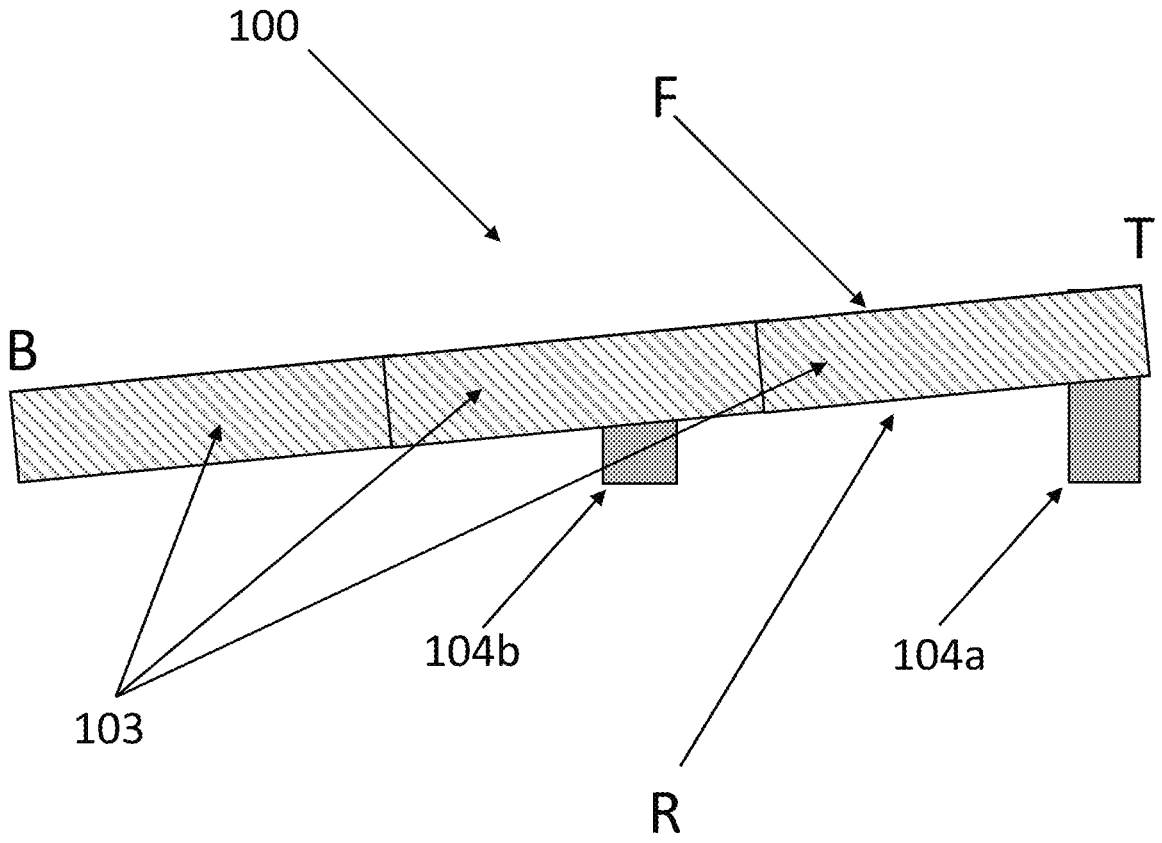
FIG. 1B illustrates a side view of the game board system according to the exemplary embodiment of FIG. 1A.

FIG. 1A and FIG. 1B illustrate a game board system 100 according to an exemplary embodiment of the present inventive concept. The game board system 100 is preferably three-dimensional in shape, and includes a display surface 102 including a front side "F" which acts as a target for multiple different sports games. The game board system 100 can include a pair of legs 104*a* disposed adjacent to a top portion T thereof and extending from opposite sides of a rear side "R" of the display surface 102. The pair of legs 104*a* support the game board system 100 to remain at a predetermined slope with respect to a surface in which the game board system 100 rests such that users can see the front side F of the display surface 102 while standing at a distance away from a bottom portion B of the game board system 100 in order to help the users aim bean bags (not illustrated), or other similar objects at different holes and/or markings, such as numbers and words, as desired depending on the sports game that is presently being played. The predetermined slope also aids in slowing down the bean bags as each bag makes contact with the front side F of the display surface 102 after being tossed at a trajectory from the user to the game board system 100, as described in more detail below.

The game board system 100 can also include a second pair of legs 104*b*, each leg 104*b* being disposed approximately at the middle portion thereof and at opposite sides 103 thereof. The legs 104*b* can extend away from the rear side R of the display surface 102 to a length such that the legs 104*b* rest on the same surface which the legs 104*a* rest on. The legs 104*b* provide extra support for the middle portion of the game board system 100.

The display surface 102 can include a large diamond shape 102*a* disposed on the front side F thereof. The diamond shape 102*a* can have a top corner reach the top portion T of the display surface 102, a bottom corner reach the bottom B of the display surface 102, and two opposing side corners, each side corner reaching a respective side of the display surface 102. The diamond shape 102*a* can be configured to provide boundary lines for multiple different sports games that can be played with the game board system 100, as is described in more detail below. The diamond shape 102*a* can include a plurality of equal size smaller diamond shapes 102*a*1 that fill the entire area within the diamond shape 102*a*. A plurality of different uses for the smaller diamond shapes 102*a*1 will be described in the various exemplary embodiments described below.

Connected at the top T of the game board system 100 can be a bracket 105 to receive a pole therethrough to provide additional games, such as basketball and ring-toss, which are described in more detail below with reference to FIGS. 5A through 5C.

Figure 1C:
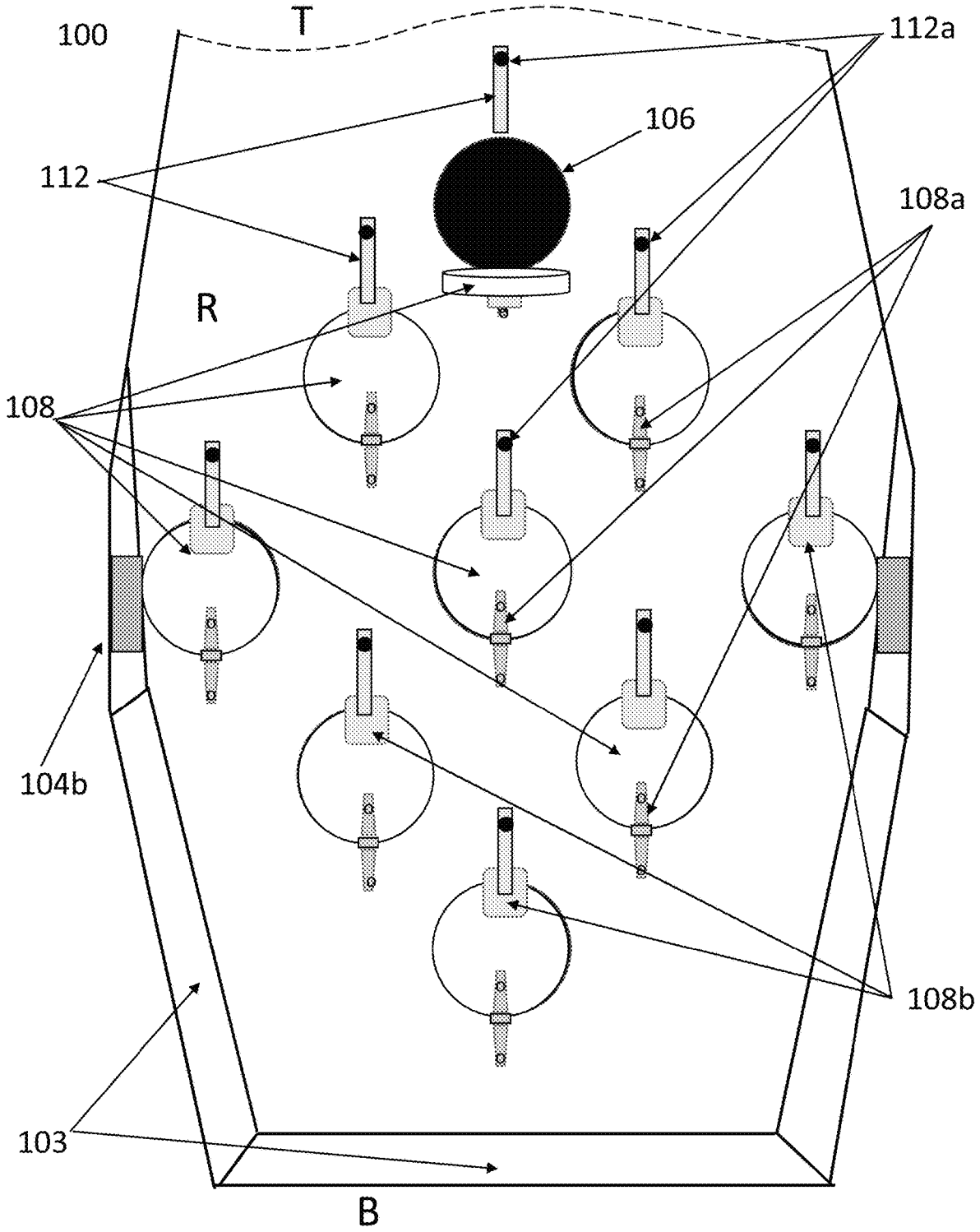
FIG. 1C illustrates a back view of the game board system according to the exemplary embodiment of FIG. 1A.

FIGS. 1A and 1C illustrate an exemplary embodiment of a configuration of the game board system 100 in which one hole 106 is exposed (top most hole) while eight other holes 106 are covered by a respective rotating circular door 108. Each rotating door 108 can be attached to a rear side R of the display surface 102 at a location adjacent to a periphery of a respective hole 106. More specifically, the rotating doors 108 can be attached to the rear side R of the display surface 102 via a respective hinge 108*b*, or any other equivalent element that will provide for rotating the doors 108 to open and close openings of a respective hole 106.

FIG. 1C illustrates the rear side R of the display surface 102 of the game board system 100. Each of the rotating doors 108 can also include a tab 108*b* attached at a back side thereof at a position on the door 108 at an angle of approximately 180 degrees from where each respective hinge 108*b* is disposed. The tabs 108*b* are configured to sit against the rear side R of the game board display surface 102 when the respective door 108 is rotated to fully close the corresponding hole 106.

A sliding latch 112 can also be attached adjacent to an opposite side of each hole 106 with respect to the side of each hole 106 in which a corresponding hinge 108*a* is disposed. The doors 108 are preferably the same thickness as the game board display surface 102 so that the doors 108 sit flush with the front side F of the game board display surface 102 and the back side B of the game board display surface 102, thus providing a continuous flat display surface 102 when all of the doors 108 are positioned within a respective hole 106.

The sliding latches 112 can include a knob 112*a* connected to an outer sliding part (not illustrated) that can be engaged by a user's finger to slide the latch 112 along a track part (not illustrated) and over a corresponding tab 108*b* to lock the tab 108*b* against the rear side R of the display surface 102, thus locking the corresponding door 108 at a position disposed within and blocking the respective hole 106. It is to be noted that any type of sliding latch or other locking device can be used which provides the intended purposes of locking and unlocking the tab 108*b* of the door 108 against the rear side R of the display surface 102 and the door 108 within the respective hole 106, when desired, depending on the sports game being played at the present time. Therefore, specific elements of the sliding latch 112 are not illustrated in order to provide brevity to the detailed description.

The entire game board system 100, including the display surface 102, sides 103 and the doors 108 can be formed of a wood, a wood composition, or any other material that provides the intended purposes of providing a solid, sturdy, light weight system that can be easily carried from place to place, and be used outdoors. The game board system 100 can alternatively be formed of a hard plastic material, fiberglass, etc.

Still referring to FIG. 1A, the game board display surface 102 illustrates several sets of numbers as well as words (First, Second, Third and Home) within the diamond shape 102*a*. These sets of numbers and words can be used for various different sports games other than corn hole, as is described in more detail below. Some of the sports games that the different sets of numbers and words are used for are, for example, baseball, nine-hole golf, point scale, close four corners, etc. It is to be noted that none of the markings in the diamond shape 102*a* are used for this well-known game of corn hole as illustrated in FIG. 1A.

Figure 2:
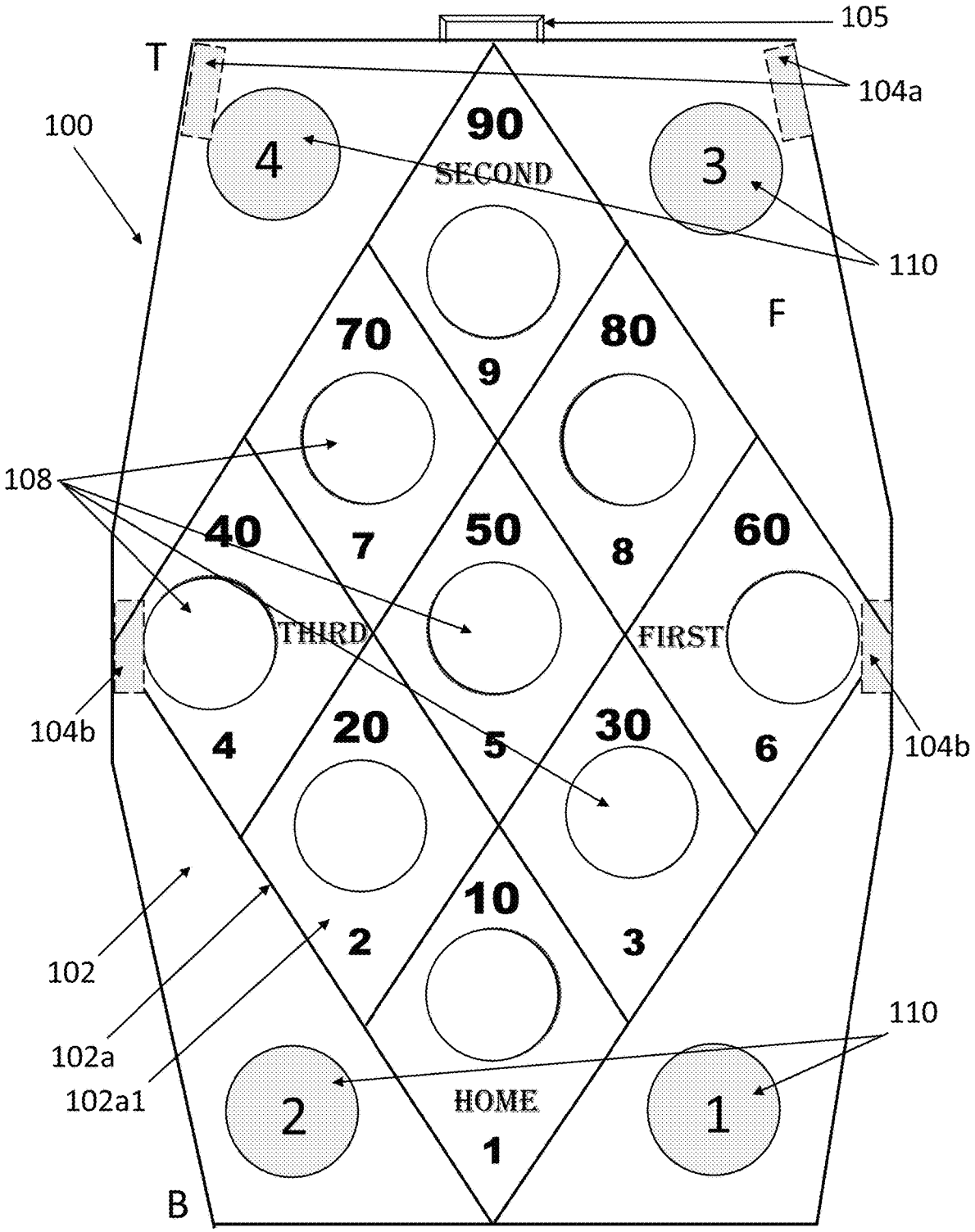
FIG. 2 illustrates a top view of the game board system according to the exemplary embodiment of FIG. 1, simulating a configurating of a game called "close four corners" bean bag toss.

FIG. 2 illustrates a top view of the game board system according to the exemplary embodiment of FIG. 1, simulating a configurating of a game called "Close Four Corners," and can be played by tossing bean bags onto four circles 110. FIG. 2 illustrates the display surface 102 of the game board system 100, where all of the doors 108 are in a closed position. In this configuration the display surface 102 and doors 108 act together as a surface for bean bags to land on and slide across. At each of four outer corners of the display surface 102 is disposed a circle 110. The circles 110 are numbered from 1 to 4. The goal of this game is to cover each of the four circles 110 with bean bags. The player or team that first tosses a bean bag on each of the four circles 110 (1 to 4) is determined to close the four corners, and therefore wins the game. This game is called "Close Four Corners."

In this configuration the diamond 102*a* disposed on the display surface 102 is not used, as none of the numbers or words disposed within the diamond 102*a* correspond with this game. The four circles 110 (1 to 4) can be colored a specific color, such as blue, to distinguish these circles 110 from the other marks on the display surface 102 in order to indicate to each of the players that these blue circles 110 are the ones that are used to toss a bean bag on for this game specific game of close four corners. As illustrated, the four circles 110 for this game are placed outside of the diamond 102*a*, two circles at the top portion T of the game board 100 and at opposite sides thereof, the two circles at the bottom portion B of the game board 110 and at opposite sides thereof.

Figure 3:
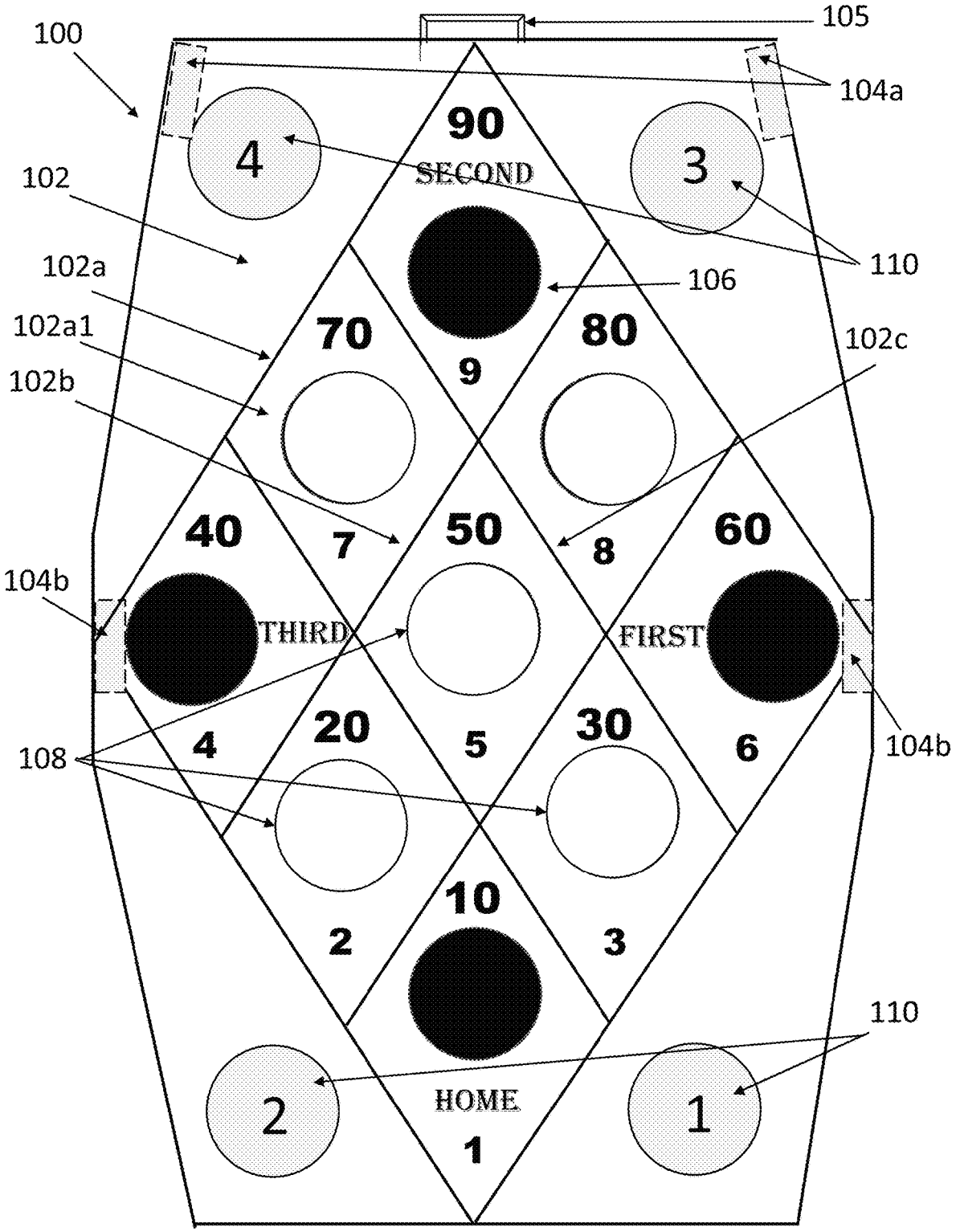
FIG. 3 illustrates a top view of the game board system according to the exemplary embodiment of FIG. 1, simulating a game called "baseball" bean bag toss.

FIG. 3 illustrates a top view of the game board system according to the exemplary embodiment of FIG. 1, simulating the well-known sports game of "baseball," provided in the form of a bean bag toss game. FIG. 3 illustrates the display surface 102 of the game board system 100, where the diamond 102*a* includes lines 102*b* and 102*c* which together form cross hatches, similar to a tic-tac-toe board. Each of nine equal sized diamond shape boxes 102*a*1 are formed by the cross hatches, wherein each small diamond shaped box 102*a*1 can include one hole 106 disposed therein. The positions of the doors 108 in FIG. 3 are configured to provide the game of baseball. More specifically, the lowermost diamond shaped box 102*a*1 includes a hole 106 that represents "home base," and adjacent to this hole 106 can be written the word "Home." The rightmost diamond shaped box includes a hole 106 that represents "first base," and adjacent to this hole 106 can be written the word "First." The topmost hole 106 can represent "second base," and adjacent to this hole 106 can be written the word "Second." The leftmost hole 106 can represent "third base," and adjacent to this hole can be written the word "Third." In this configuration, only the holes 106 adjacent to the words first, second, third and home are open, thus allowing a bean bag to pass through the holes 106 to receive a base hit, double, triple or home run, similar to the way the game of baseball is played. All of the other doors 108 are in the closed position to block off the other holes 106, thus providing a baseball diamond 102*a* the bean bags can slide across until they fall into one of the first, second, third or home base holes 106.

Two teams (one or more players per team) can play this game of baseball, wherein after nine innings the team or person with the most runs wins. Generally four bags per team are sufficient to play this game. When a bean bag is tossed into one of the holes 106, a base is taken. If a tossed bean bag falls off the board, this can be considered one out, where each team gets three outs per inning. If a later tossed bean bag knocks a previously tossed bean bag off the display surface 102 and into a hole, then the base in which the bean bag falls in is a base taken for the team. If a later bean bag tossed knocks a bean bag lying on the display surface 102 off the display surface 102, then the team receives an out. Similar to baseball rules, each team must complete force a user on a base to "home base" in order to receive a run (i.e., score a point). The teams can choose to play a full inning before the opposing team starts tossing bean bags, or the two teams can alternate tossing the bean bags.

Figure 4:
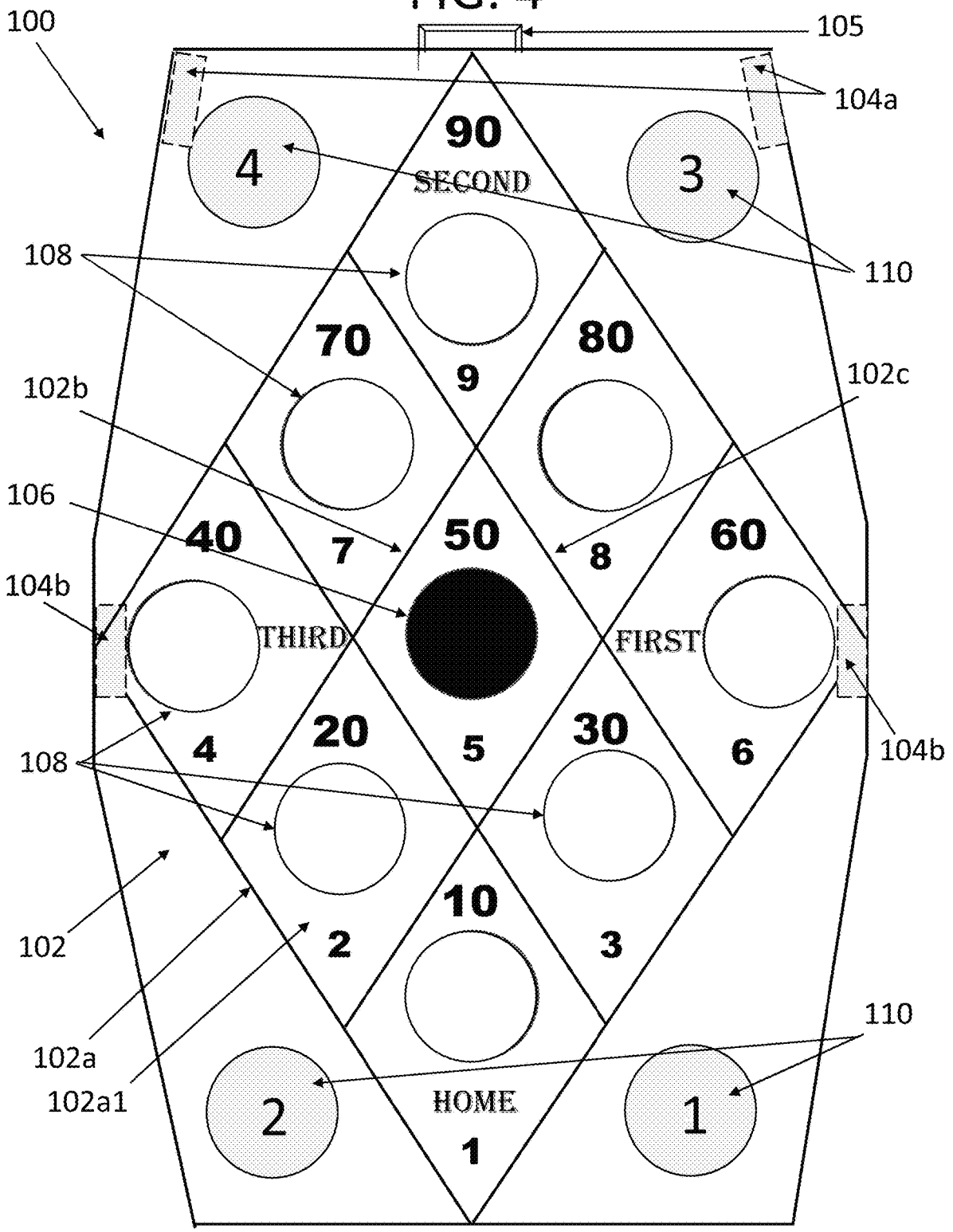
FIG. 4 illustrates a top view of the game board system according to the exemplary embodiment of FIG. 1, simulating a golf game called "hole-in-one" bean bag toss.

FIG. 4 illustrates a top view of the game board system according to the exemplary embodiment of FIG. 1, configured to simulate a golf game called "hole-in-one" bean bag toss. FIG. 4 illustrates the display surface 102 of the game board system 100 with the diamond 102*a* including the lines 102*b* and 102*c* forming cross hatches, which in turn form the nine diamond shape boxes 102*a*1 each including one hole 106 disposed therein. FIG. 4 is configured to provide the game of "Hole in One." More specifically, only the center diamond shaped box includes an exposed hole 106 that represents a target to toss a bean bag therein. All of the other eight holes 106 are closed by a corresponding rotating door 108. Here there can be as many teams as desired. Before the game of "Hole in One" begins, a number can be chosen to be reached in order to win the game. For example, the teams can decide to choose the number 1,000, and each time a team tosses a bean bag into the center hole 106 the team obtains 50 points (see the number 50 above the center hole 106). There can be four bags per team, for example, or as many bags per team as desired. Once a team accumulates 1,000 points, that team wins the game. The teams can decide to rotate tosses, or the teams can decide to toss all of the bean bags in the teams possession before another team tosses their bean bags. Since all of the holes 106 except the center hole 106 are closed by a corresponding door 108, the tossed bean bags will slide over the closed doors 108 as if the doors 108 were part of a continuous display surface 102 of the game board system 100.

Figure 5A:
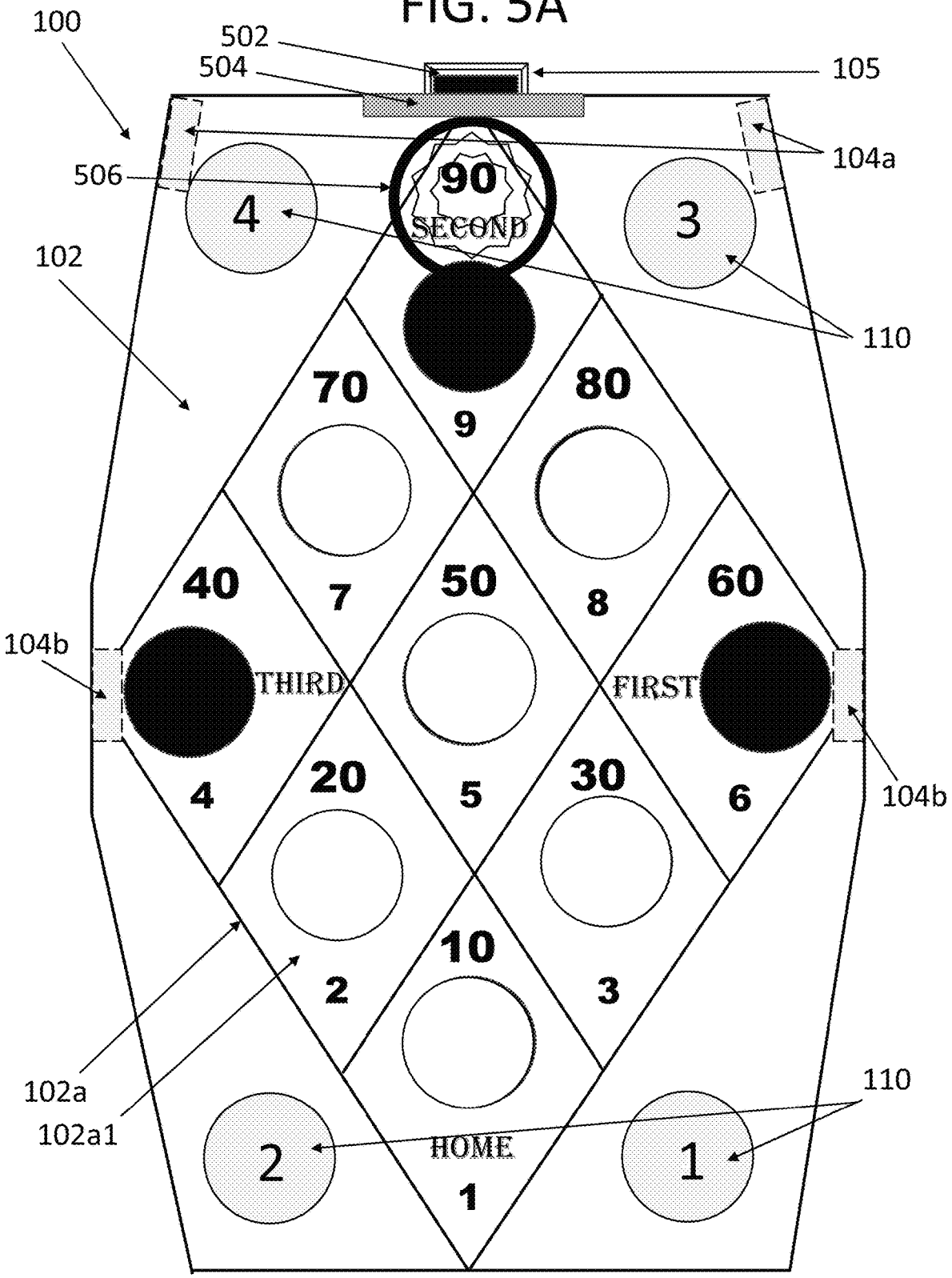
FIG. 5A illustrates a top view of a game board system according to another exemplary embodiment of the present inventive concept, simulating a game called "basketball" bean bag toss.

FIG. 5A illustrates a top view of a game board system according to another exemplary embodiment of the present inventive concept, simulating a game called "basketball" bean bag toss. In this configuration, the game board system 100 is the same as the game board system of FIG. 1, however, the game board system 100 is also configured to include an attachable basketball hoop system 500, which is attachable to the bracket 105.

Figure 5B:
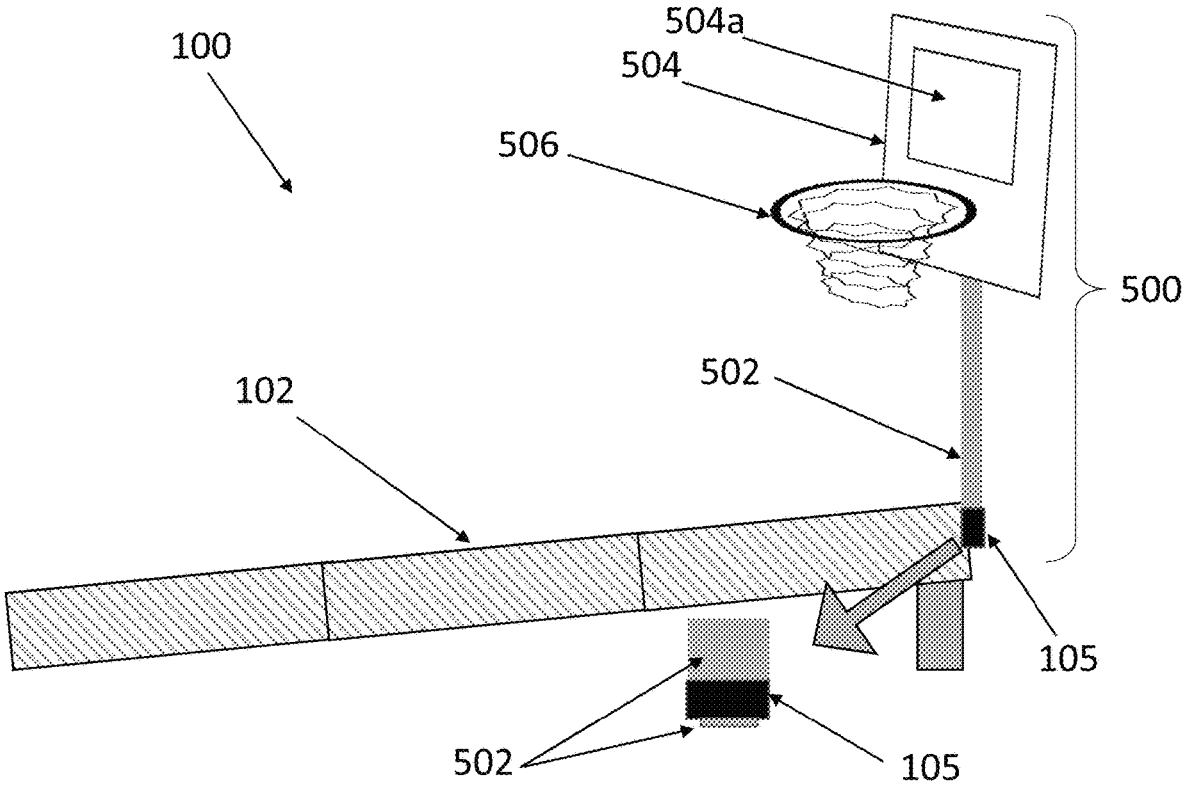
FIG. 5B illustrates a side view of the game board system simulating the game basketball bean bag toss, in accordance with the exemplary embodiment of FIG. 5A.

FIGS. 5A and 5B illustrate the game board system 100 configured to provide the game of basketball to be played with bean bags. As illustrated, an extension pole 502 is provided which extends by a predetermined length, and has a basketball backboard 504 connected at a first end thereof. While the backboard 504 is connected to the first end of the pole 502 at one side thereof and along a center of the backboard 504, an opposite side of the backboard 504 has a hoop 506 connected thereto, similar to a basketball backboard and hoop combination in the well-known game of basketball.

A second end of the pole 502, opposite the first end in which the backboard 504 is connected, can be configured to slide into the bracket 105 provided at the top center portion of the game board system 100. The pole 502 can be flat with a larger width than thickness. Further, as illustrated in FIG. 5B, the second end of the pole 502 can have a thickness slightly smaller than an opening in the bracket 105 for a length equal to the height of the bracket 105. The remaining length of the pole 502 can have a thickness larger than the opening of the bracket 105 such that the pole 502 only extends through the bracket 105 by a certain amount, thus holding the backboard 504 and hoop 506 combination at a predetermined height above the display surface 102. In other words, with this configuration the pole 502 can slide into the bracket 105 by a predetermined amount and remain therein while extending upward to hold the backboard 504 and hoop 506 combination above the game board system 100 by a predetermined height, thus providing a hoop 502 hoovering over the game board system 100 for players to toss bean bags therethrough in order to score points.

Game rules can be provided such that the only holes 106 that are open are the top most hole 106 and the two far most side holes 106 (left and right). In other words, the top most hole 106, and the left and right most positioned holes 106. Here, when a user tosses a bean bag into the top hole 106 positioned below the hoop 506, the player gains two points. If a player tosses a bean bag into one of the two side holes 106, the player obtains a foul, at which point a player on the other team can be required to back up a few steps and take a foul shot to gain a point. Further, when a player tosses a bean bag directly into the hoop 506, this player gains three points. The game can be played either for certain period of time or up to a certain number of points.

Figure 5C:
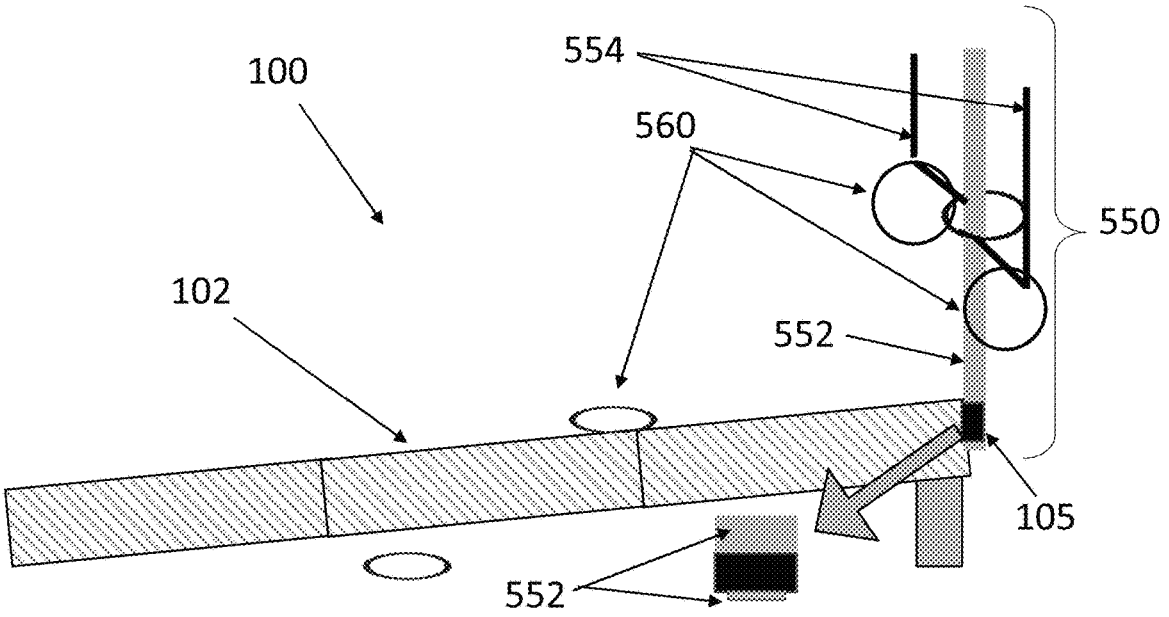
FIG. 5C illustrates a side view of a game board system according to another exemplary embodiment of the present inventive concept, simulating a game called "ring toss."

FIG. 5C illustrates a side view of a game board system according to another exemplary embodiment of the present inventive concept. This configuration simulates a game called "Ring Toss." In this configuration, the game board system 100 is the same as the game board system of FIG. 1 and FIG. 5A, however, the game board system 100 configuration for this exemplary embodiment also includes a ring toss pole attachment 550, which is removably attachable to the bracket 105.

FIG. 5C illustrates the game board system 100 configured to provide the game of "Ring Toss" to be played with a set of rings 560. The ring toss pole 550 is preferably configured with a center pole 552 having a width and thickness similar to the pole 502 described above with respect to the exemplary embodiment of FIGS. 5A through 5B. The height of the center pole 552 can be any desired height such that a player of the ring toss game can toss a ring 560 over the pole 552 or additional extension poles 554. In other words, the center pole 552 can also include one or more extension poles 554 extending substantially perpendicular to the center pole 552 and then bending upward at an angle substantially perpendicular to the center pole 552, thus extending in the same direction as, and in parallel with the center pole 552. With this configuration the extension poles 554 can also catch rings 560 as the rings 560 are tossed at the ring toss pole 550. Players of the ring toss game can choose a number of points to achieve in order to win the game. Points can be accumulated by getting a ring 560 to be looped over either the center pole 552 or one of the extension poles 554. The poles 552 and 554 can also be provided in different colors and represent different numbers of points. The Ring Toss game illustrated in FIG. 5C can be played until a set number of points is met by a team, or can be played for a predetermined set period of time, at which point the team or individual player accumulating the most points at this predetermined time period wins the game.

Figure 6:
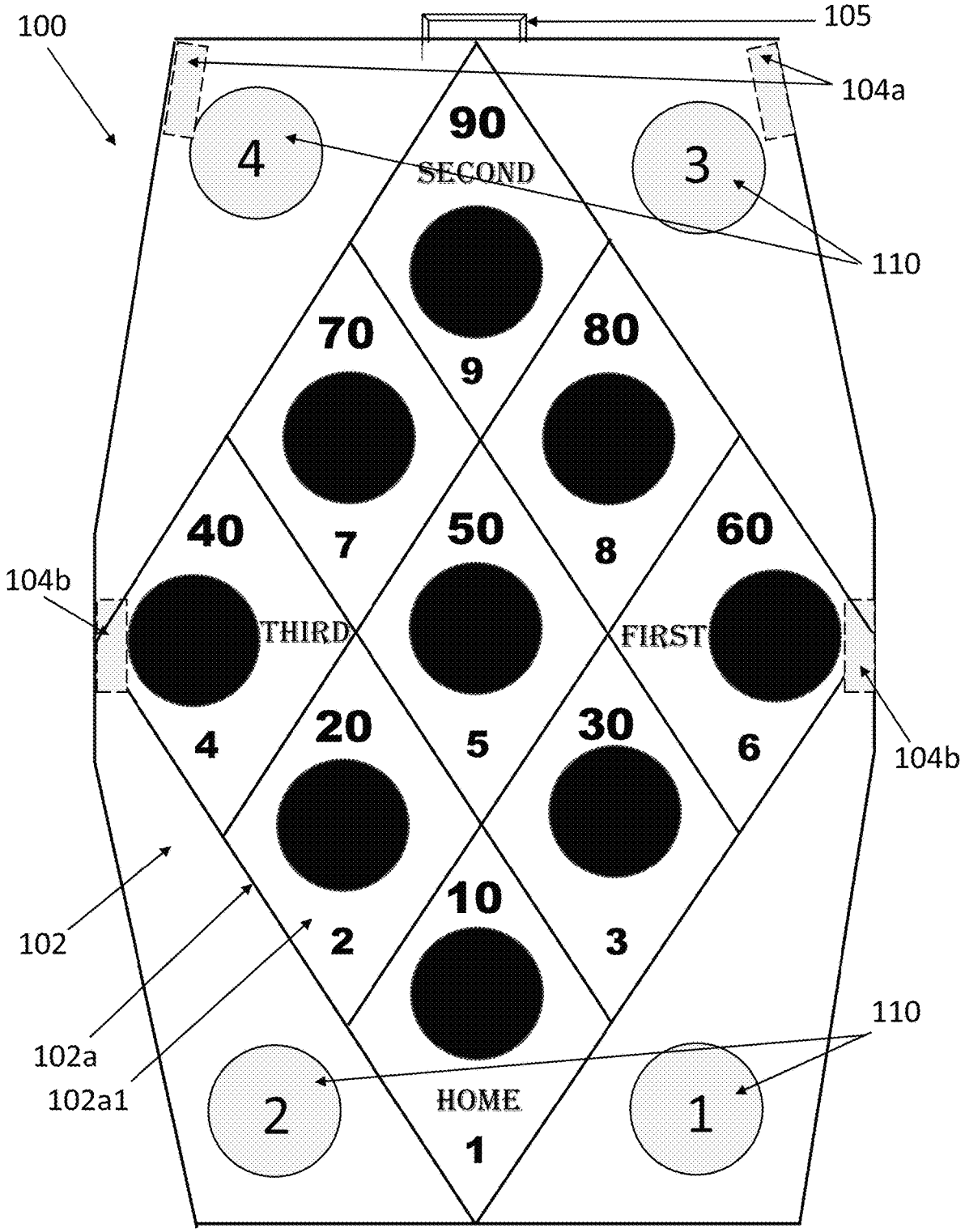
FIG. 6 illustrates a top view of the game board system according to the exemplary embodiment of FIG. 1, simulating both a game called "nine hole golf" bean bag toss and game called "point scale" bean bag toss.

FIG. 6 illustrates a top view of the game board system 100 according to the exemplary embodiment of FIG. 1, simulating both a game called "Nine Hole Golf" bean bag toss and a game called "Point Scale" bean bag toss.

FIG. 6 illustrates a top view of the game board system 100, showing the display surface 102 with the diamond 102*a* with the smaller equal shaped diamonds 102*a*1 each including one hole 106 disposed therethrough. In this configuration, all of the equal shaped diamonds 102*a*1 include an exposed hole 106 that represents a target to toss a bean bag therethrough. This game can be simultaneously played by as many individuals or teams as desires. From bottom to top of the diamond 102*a* each of the holes 106 are numbered from one through nine (numbers are provided below the holes 106). These numbers one through nine, and their respective holes 106 represent the nine holes of the well-known game of Nine Hole Golf.

The object of this game is to close each of the holes 106 starting with the first hole 106 numbered one (bottom of diamond 102*a*) and ending with the last hole 106 numbered nine (top of diamond 102*a*). The first individual or team to close each hole 106 wins the game. Further, each time all of the individuals (or teams) toss a bean bag into a hole 106 (hole number one being first, hole number two being second, etc.), that hole 106 gets closed by rotating the corresponding door 108 over the hole 106 and latching the door 108 closed via the corresponding latch 112 by sliding the latch 112 to lock the tab 108*b* against the rear side R of the display surface 102. Accordingly, after all of the individuals (or teams) have tossed a bean bag into one of the nine holes 106, that specific hole becomes closed for the remainder of the game. It is to be noted that these numbers one through nine can be provided in a specific unique color, for example, green, so that the players know which set of numbers they are following for this game of Nine Hole Golf.

Figure 7:
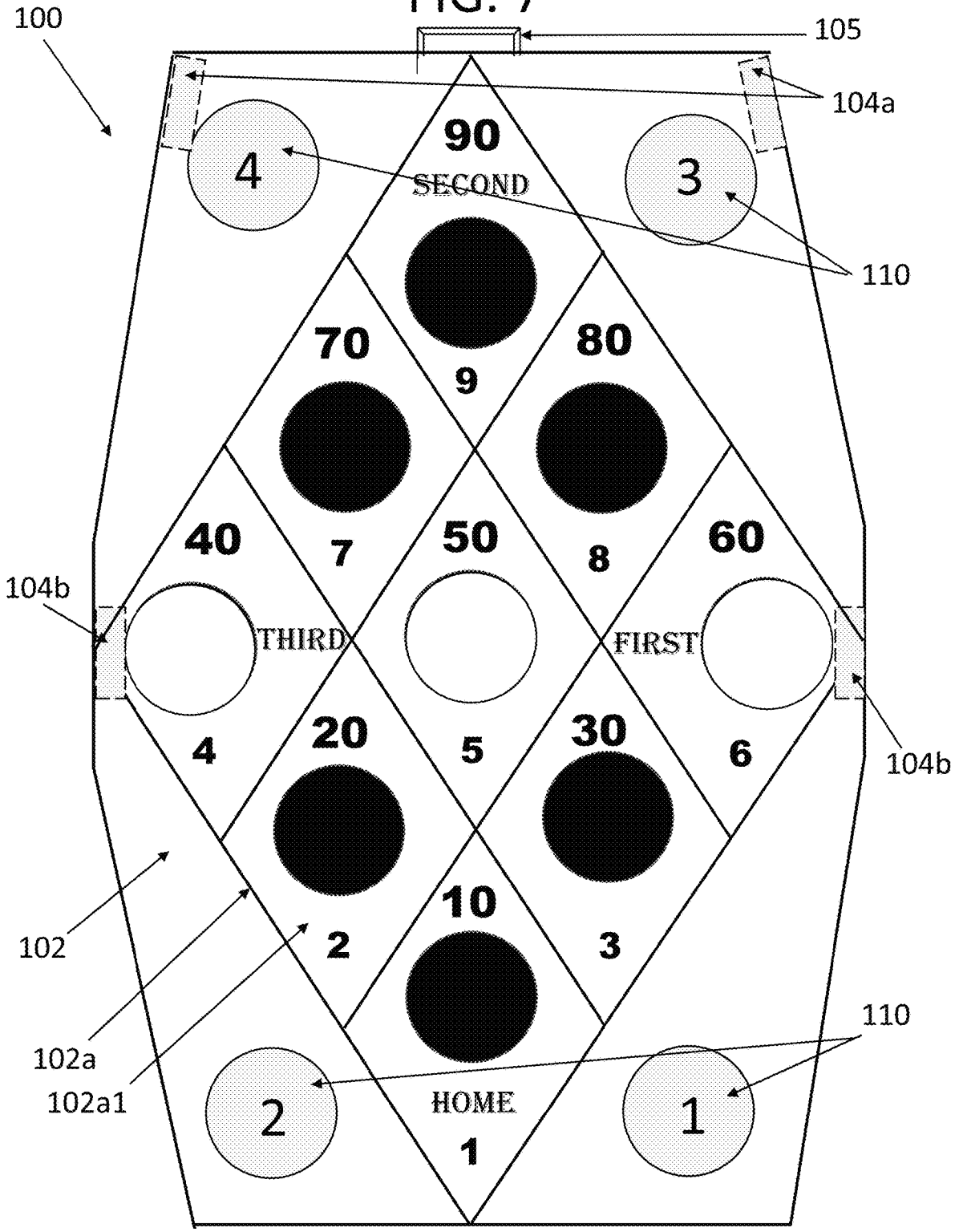
FIG. 7 illustrates a top view of the game board system according to the exemplary embodiment of FIG. 1, simulating a game called "Tic-Tac-Toe" bean bag toss.

FIG. 7 illustrates a top view of the game board system 100 according to the exemplary embodiment of FIG. 1, but configured to simulate a game called "Tic-Tac-Toe" bean bag toss. FIG. 7 illustrates a top view of the game board system 100, showing the display surface 102 with the diamond 102*a* and smaller equal sized diamonds 102*a*1 disposed therein the diamond 102. As described above, each of the nine equal sized diamond shapes include one hole 106 disposed therethrough. In this configuration, all of the small diamonds 102*a*1 include an exposed hole 106 that represents a target to toss a bean bag therein. Similarly to the well-known game of tic-tac-toe, the first player or team to toss a bean bag into three holes 106 in a row first wins the game. With this configuration, once a player of team tosses a bean bag into any hole 106, that specific hole becomes closed by rotating the corresponding door 108 over the hole 106, and then sliding the latch 112 over the tab 108*b* to lock the door 108 within the corresponding hole 106. With this game it is imperative that individual players (or teams) rotate turns the same way the well-known game of tic-tac-toe is played.

Although the game of tic-tac-toe using the display surface 102 begins with all of the holes 106 fully opened, FIG. 7 is provided to show how a row of holes 106 have been closed due to bean bags being tossed into the row of holes 106 extending from the far left most hole 106 to the far right most hole 106, thus completing the game of tic-tac-toe only if one player or team was the first one to toss the bean bags into each of the three holes. It is to be noted that this configuration of only three holes 106 being closed to win the game can only be accomplished if the other player or team has failed to toss any of the bean bags into a hole 106.

Figure 8:
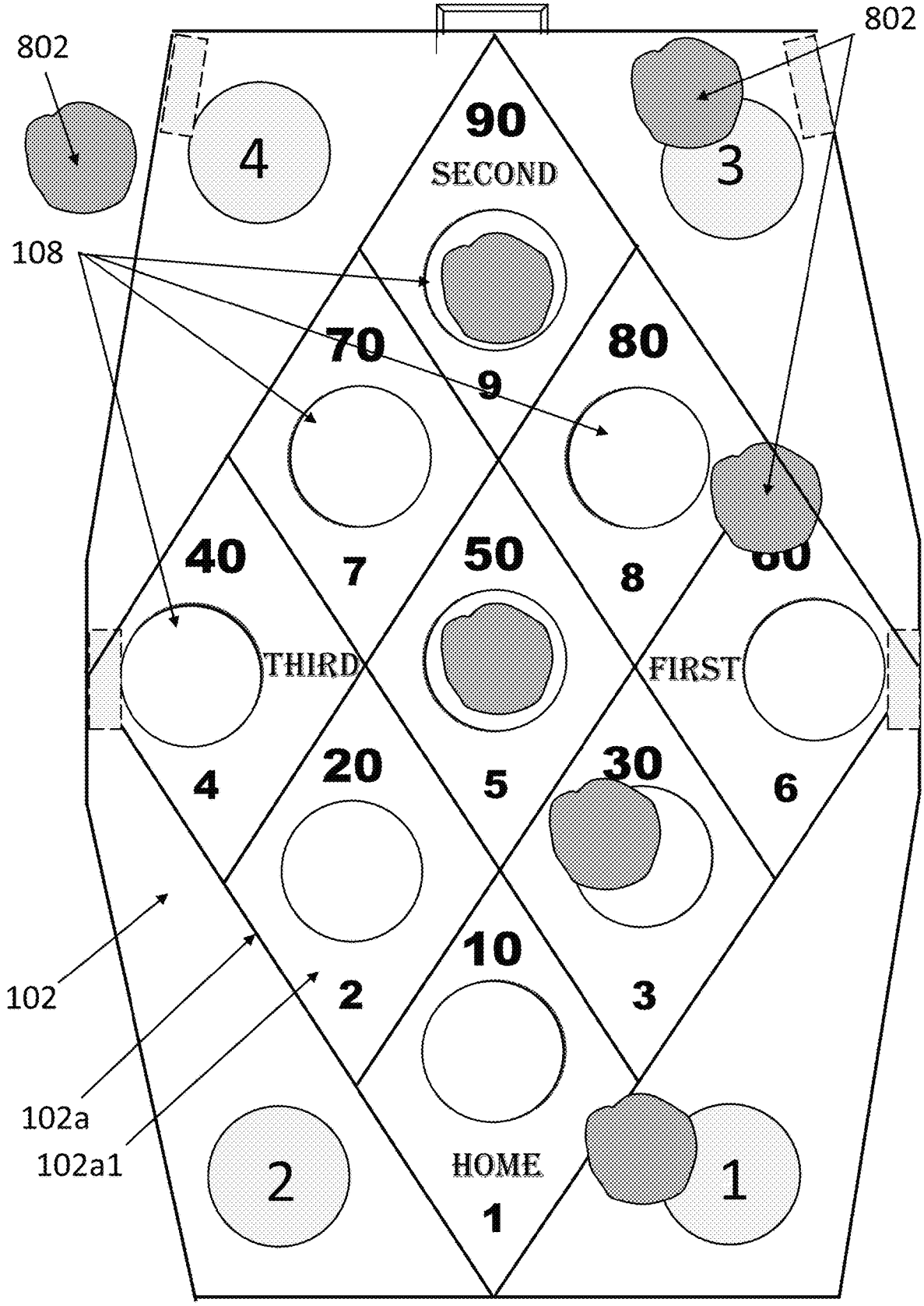
FIG. 8 illustrates a top view of the game board system according to the exemplary embodiment of FIG. 1, simulating a game called "Stay In the Circles" bean bag toss.

FIG. 8 illustrates a top view of the game board system 100 according to the exemplary embodiment of FIG. 1, but configured to simulate a game called "Stay In the Circles" bean bag toss. This game requires all of the nine holes 106 to be closed with a respective door 108. This game is very challenging, and thus more for experienced bean bag toss players than novice level players. More specifically, the object of this sports game is to accomplish tossing a bean bag 802 in such a way that once the bean bag is resting of the display surface 102, the bean bag is sitting within a circumference of a door 108, and not crossing over the periphery of a door 108 and over the display surface 102 itself. This game can also be played to accumulate points, using either the set of numbers 109 or the set of numbers 10-90 disposed in the small diamond shapes 102*a*1. The game can be played until one player of team reaches a certain number of points, or until a certain predetermined time period has expired, at which time the player of team with the highest number of points wins.

FIG. 8 illustrates where two bean bags have accumulated points by landing within the periphery of the doors 108 in the top most diamond 102*a*1 and the center diamond 102*a*1. All other bean bags have failed to land exclusively within a perimeter of a door 108, and therefore gain no points. The game can be played until one player of team reaches a certain number of points, or until a certain predetermined time period has expired, at which time the player of team with the highest number of points wins.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A multi-configurable sports game system, comprising:

a three dimensional game board including:

a display surface, the display surface including:

a large diamond shape disposed thereon and having a top most corner contacting a top portion T of the display surface, a bottom most corner contacting a bottom portion B of the display surface, a left most corner contacting a first side and a right most corner contacting a second side opposite the first side, nine small diamond shapes disposed within the large diamond shape that fill in the entire large diamond shape, and nine holes extending through the display surface, each hole being disposed within a respective small diamond shape, a rotating door connected adjacent to a periphery of each hole via a hinge such that each rotating door can rotate between an open position below the display surface where the respective hole is completely exposed and a closed position where the respective hole is completely filled in by the door, a latch disposed at a back side of the display surface adjacent to every hole to lock and unlock a respective door within the respective hole, each latch being positioned at an angle of approximately 180 degrees from the respective hinge, and a first pair of legs, each first leg extending from a bottom of the display surface at each of opposite sides of a top end of the game board.

2. The multi-configurable sports game system according to claim 1, further comprising:

at least two sets of numbers disposed in each of the small diamond shapes representing scores to be obtained from at least four separate sports games; and four circles formed on the display surface outside the large diamond shape, one circle being formed between each of a top side of the large diamond shape and an edge of the game board, another top side of the large diamond shape and another edge of the game board, a bottom side of the large diamond shape and an edge of the game board, and another bottom side of the large diamond shape and another edge of the game board, the four circles representing scores to be obtained in at least one other sports game separate from the scores disposed within the small diamond shapes.

3. The multi-configurable sports game system according to claim 2, further comprising:

words provided in each of a lower most small diamond which represents home base, a right most small diamond which represents first base, a top most small diamond which represents second base, and a left most small diamond which represents third base of baseball.

4. The multi-configurable sports game board system according to claim 1, further comprising:

a second pair of legs, each second leg extending from a bottom of the display surface at each of opposite sides of a middle portion of the game board and contacting a surface on which the first pair of legs rest and the bottom of the game board rests.

5. The multi-configurable sports game system according to claim 1, further comprising:

a bracket disposed on a top side thereof to receive a post for a basketball hoop and a game of ring toss.

6. A multi-configurable sports game board system, comprising:

a display surface including:

a large diamond disposed thereon having four points, each point extending to a top of the display surface, a bottom of the display surface, and two opposite sides of the display surface, nine equal sized small diamonds disposed within the large diamond and all being in contact with adjacent ones thereof to fill the entire area of the large diamond, each small diamond having at least two sets of numbers disposed therein representing scores to be obtained in at least two separate sports games and one set of words disposed in at least four of the nine small diamonds, the words representing bases in the game of baseball, a rotatable door formed in each of the nine small diamonds, each door being configured to rotate to expose a corresponding hole extending through the display surface and to close the corresponding hole to form a continuous surface with the display surface, and a latch formed at a rear side of the display surface adjacent to each hole, each latch being movable to lock a respective door in a closed position within the corresponding hole and to unlock the door to rotate the door outside of the corresponding hole and below the display surface.

7. The multi-configurable sports game board system according to claim 6, further comprising:

at least two legs extending from a bottom thereof configured to prop up a top end thereof.

8. The multi-configurable sports board game system according to claim 7, further comprising:

a bracket disposed on the top end thereof to receive a post connected to at least a basketball hoop and to a set of poles connected together and configured to receive a ring tossed thereover.

9. The multi-configurable sports game board system according to claim 6, wherein the game board and display surface comprises eight sides.

10. The multi-configurable sports game board system according to claim 6, further comprising:

a circle disposed at a top portion of the display surface at each of opposite sides thereof and outside the large diamond and at a bottom portion of the display surface at each of opposite sides thereof and outside the large diamond, each of the circles configured to receive a tossed bean bag thereon to gain a point.

11. The multi-configurable sports game board system according to claim 6, further comprising:

a hinge attached at one side to each door and attached at a opposite side to the rear side of the display surface adjacent to a corresponding hole, the hinges being configured to rotate the corresponding doors between a position within a corresponding hole and a position to expose the corresponding hole.

* * * * *